United States Patent [19]

Kaminski

[11] Patent Number: 4,760,729

[45] Date of Patent: Aug. 2, 1988

[54] DUAL RAM PRESS

[75] Inventor: Elton G. Kaminski, Sidney, Ohio

[73] Assignee: The Stolle Corporation, Sidney, Ohio

[21] Appl. No.: 140,878

[22] Filed: Jan. 6, 1988

Related U.S. Application Data

[63] Continuation of Ser. No. 845,222, Mar. 27, 1986, abandoned.

[51] Int. Cl.[4] ..... B21D 51/44

[52] U.S. Cl. ..... 72/456; 72/455; 72/405; 72/472; 72/417; 100/214; 29/430

[58] Field of Search ..... 100/208, 214; 72/456, 72/404, 405, 472, 417, 418, 455, 471; 29/430

[56] References Cited

U.S. PATENT DOCUMENTS

| | | | |
|---|---|---|---|
| 2,295,852 | 9/1942 | Jeune | 72/405 |
| 2,331,015 | 10/1943 | Dawes et al. | 100/208 |
| 2,869,177 | 1/1959 | Jurgeleit | 72/456 |
| 3,871,226 | 3/1975 | Janiszewski | 72/456 |
| 4,026,226 | 5/1977 | Hahn et al. | 72/405 |
| 4,355,530 | 10/1982 | Chen | 100/208 |

FOREIGN PATENT DOCUMENTS

| | | | |
|---|---|---|---|
| 870365 | 5/1971 | Canada | 72/456 |
| 1193466 | 6/1970 | United Kingdom | 72/456 |

*Primary Examiner*—David Jones

*Attorney, Agent, or Firm*—Frost & Jacobs

[57] ABSTRACT

A metalworking press for forming easy open can ends. The metalworking press includes a primary ram for suspending an upper tooling member and designed to vertically reciprocate; a primary press bed stationarily positioned beneath the primary ram for mounting a lower tooling member; a seconary ram positioned beneath the primary press bed for suspending another tooling member and designed to vertically reciprocate; a secondary press bed stationarily positioned beneath the secondary ram for mounting another lower tooling member; driving rods secured to the primary ram and the secondary ram so that the rams move in unison; and a device to vertically reciprocate the primary ram so that when the device moves the primary ram downwardly the secondary ram moves downwardly, and when the device moves said primary ram upwardly, the secondary ram moves upwardly.

4 Claims, 5 Drawing Sheets

DUAL RAM PRESS

This is a continuation of application Ser. No. 845,222, filed Mar. 27, 1986, now abandoned.

BACKGROUND OF THE INVENTION

1. Field of the Invention

The present invention pertains to a press for metalworking comprising a pair of vertically spaced apart rams and associated press beds to perform multiple tooling operations, simultaneously, on stock metal and/or blanked elements. In particular, the dual ram press is especially suited to the production of easy open pull tab can ends in which a pull tab may be formed from stock material by one ram and its associated press bed, while the easy open can end is formed on the remaining ram and its associated press bed. The dual ram press of the present invention also includes feeding the pull tab strip from one press ram to the other press ram for the purposes of staking the pull tab to the easy open can end.

2. Prior Art

Easy open can end conversion presses have been in the commercial marketplace for over 20 years. With perhaps one to two exceptions, producers of such systems have utilized press manufacturer's standard line of presses, specified certain minor modifications in conversion tooling and transfer equipment, assembled the system, and shipped the system to the end producer. Such systems were generally satisfactory for operating speeds under 400 strokes per minute and/or where no more than two complete can ends were produced per press stroke. In these systems, the tab fabricating tools and can end conversion tools are located on a common press bed and are actuated by a common ram. An example of this system is illustrated in U.S. Pat. No. 4,568,230 to Brown. In such systems, extreme care must be exercised to ensure uniform loading of the ram. At higher operating speeds of up to 700 strokes per minute, such systems are subject to destructive vibration and the total system must be properly dynamically balanced to eliminate such vibrations. Productivity demands from system users, in addition to higher operating speeds, now require systems to produce more than two can ends per press stroke. Such requirements make proper dynamic balancing more difficult, utilize more press tonnage, require more press bed and ram space for tooling placement, and restrict tooling access for maintenance purposes.

Accordingly, it is a primary aim of the present invention to increase productivity demands of conventional metalworking presses such as easy open can end conversion presses.

Another aspect of the present invention is to provide a metalworking press which can produce more than two work products per press stroke.

Another primary aim of the present invention is to increase productivity demands, but avoid increasing the size of the press bed and ram of a metalworking press.

Another characteristic of the present invention is to utilize primary and secondary rams vertically spaced from one another so as to simultaneously perform multiple tooling operations on metal material.

SUMMARY OF THE INVENTION

In accordance with the invention, a metalworking press, and particularly an easy open can end conversion press, includes a primary driven ram and associated therewith a primary press bed. Secured to the primary ram are multiple driving rods which extend through the primary press bed and are secured to a secondary ram, which in turn is associated with a secondary press bed. Optionally, the driving rods can extend from the primary ram through the primary press bed, coupled with the secondary ram, and extend to and through the secondary press bed to reduce potential lateral shifting by the secondary ram. The primary and secondary press beds would include guides made of low friction or frictionless type elements such as bronze bushings, zero clearance ball bearings, or roller bearing bushings, or the like.

In the preferred embodiment, the present invention comprises an easy open can end conversion press which produces more than two can ends per press stroke. While the can ends are being transformed into easy open can ends, stock sheetmetal material is being formed into pull tabs by blanking and stamping the pull tabs, and performing other tooling operations thereon, thereby simultaneously producing a pull tab strip. The pull tab strip is fed from its associated press ram and press bed to the other press ram and press bed forming the easy open can ends so that the pull tabs can be staked to the easy open can ends.

In the broadest sense, the present invention comprises a metalworking press having dual rams, vertically spaced from one another, associated press beds for each ram, and means to simultaneously drive the secondary ram along with the primary ram.

BRIEF DESCRIPTION OF THE DRAWINGS

Other aims and aspects of the invention will become apparent upon reading the following detailed description and upon reference to the drawings, in which.

DESCRIPTION OF THE PREFERRED EMBODIMENTS

Figure 1:
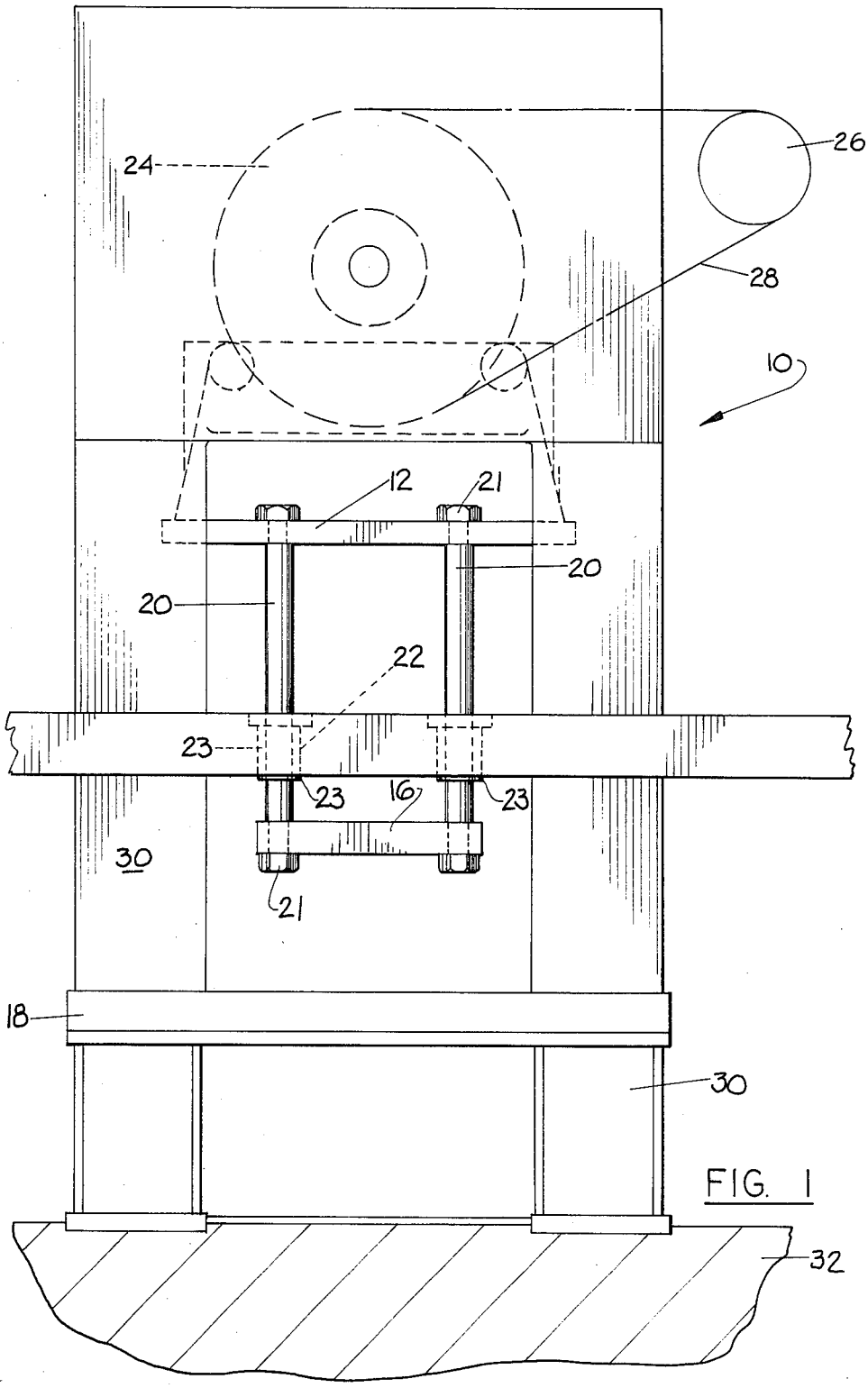
FIG. 1 is an elevational side view of a dual ram metalworking press according to the present invention.
Figure 4:
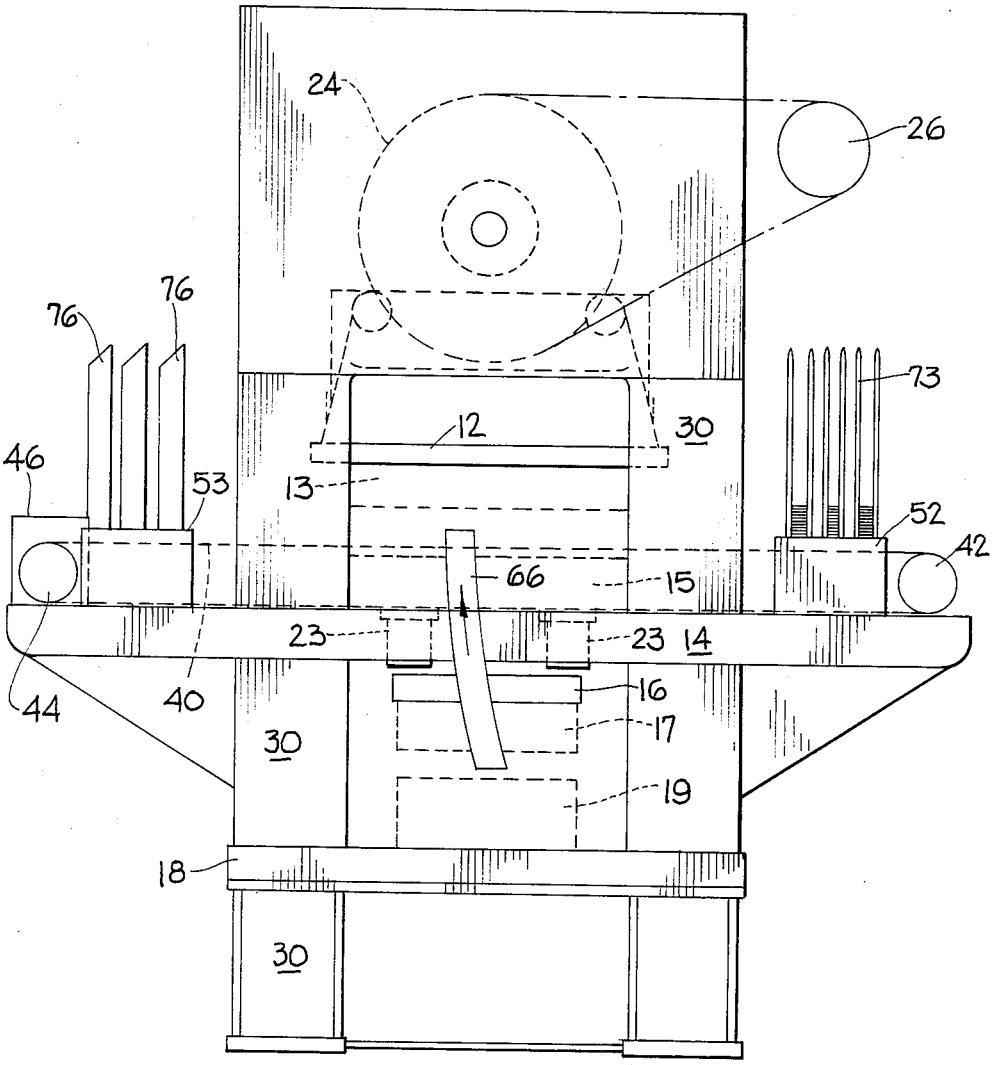
FIG. 4 is an elevational side view of an easy open conversion press illustrating the pull tab strip feeding from the secondary ram to the primary ram.
Figure 5:
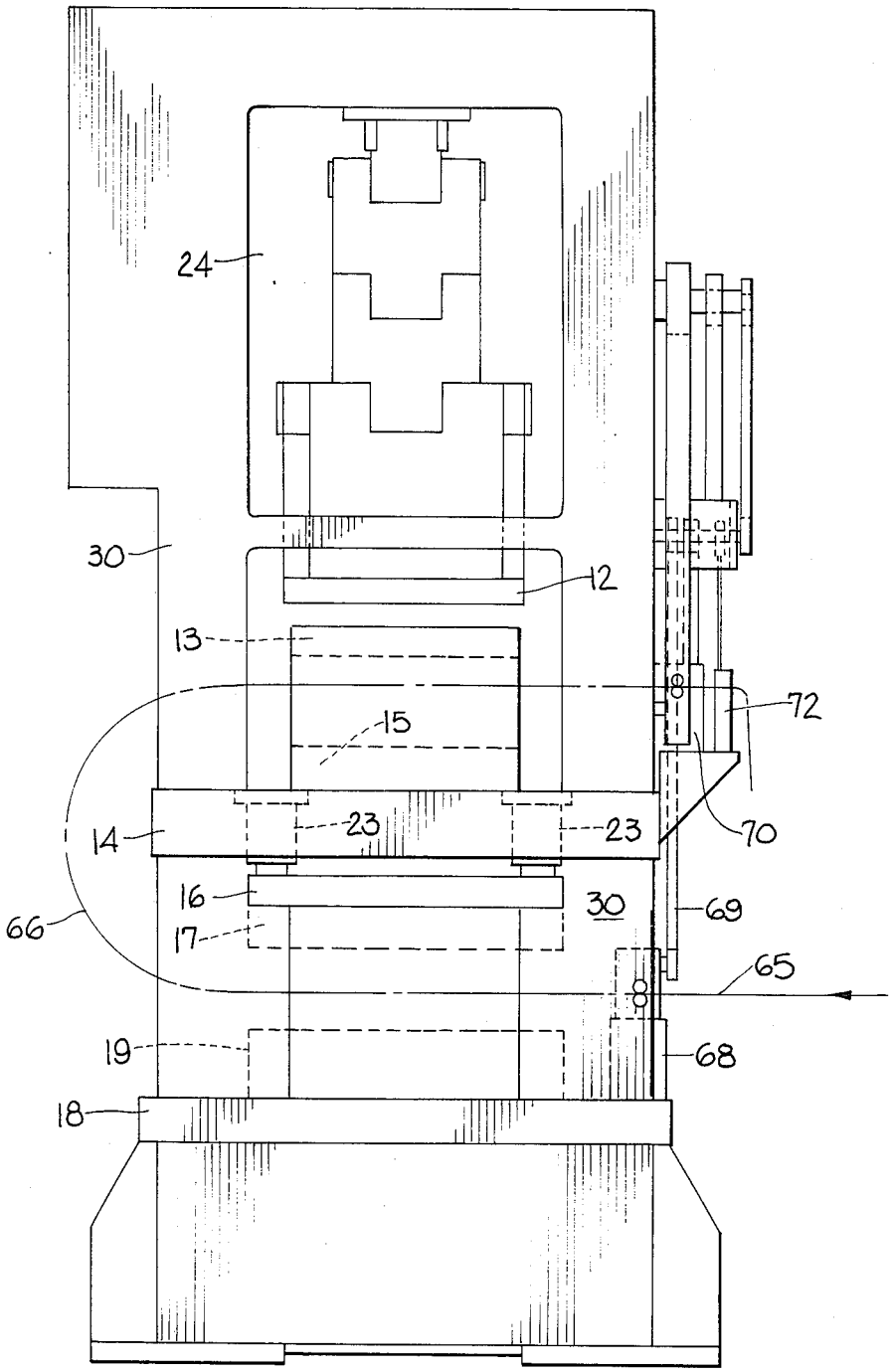
FIG. 5 is an elevational end view of the easy open conversion press illustrated in FIG. 4 showing the path of the pull tab strip as it travels from the secondary ram to the primary ram.

Turning first to FIG. 1, there is shown a metalworking press having dual press rams and respectively associated dual press beds. In particular, reference numeral 10 generally depicts a metalworking press having a primary ram 12 for securing an upper tooling member 13, as shown in FIGS. 4 and 5, to perform a specific tooling operation, and an associated primary press bed 14 for mounting a lower tooling member 15 thereon. The primary press bed 14 is in vertical alignment with the upper tooling member and the primary ram 12. The metalworking press 10 also includes a secondary ram 16 for suspending another upper tooling member 17 therefrom and a secondary press bed 18 for mounting another lower tooling member 19 thereon.

In order to shift the rams in unison with one another, there are a plurality of driving rods 20 secured to both the primary ram and the secondary ram by any conventionally known means, such as by screw threads and complementary bolts 21. The driving rods 20 extend through holes 22 in the primary press bed 14. The primary press bed 14 includes a plurality of guides 23 positioned within the holes 22 to permit the driving rods 20 to vertically reciprocate therethrough. The guides 23 may be made of a low friction or frictionless type material such a bronze bushings, zero clearance ball bearing, roller bearing bushings, or the like.

The primary ram 12 is driven by a converter 24 which converts rotary motion to reciprocating motion and may comprise a crankshaft, an eccentric shaft, link driven means, or the like. The converter 24 is powered by a motor 26 and corresponding belt 28. The particular characteristics of the converter 24, motor 26 and belt 28 are not necessary for a proper understanding of the present invention. The converter 24, primary press bed 14, and secondary press bed 18 are supported by structural supports 30 which in turn are supported upon the foundation floor 32. Specifically, the support structures 30 support the secondary press bed 18 above the floor 32. Also, the primary press bed 14 is vertically positioned above the secondary press bed 18 by the support structures 30. Additionally, the support structures 30 support the converter 24 above the primary press bed 14. Likewise, the converter 24 supports the primary ram 12 which in turn supports the secondary ram 16 by means of the driving rods 20.

For the purpose of simultaneously conducting tooling operations on metal, the motor 26 is activated which in turn activates the converter 24 causing the primary ram 12 and the secondary ram 16 to reciprocally shift upwardly and downwardly the desired distance determined by the converter. The reciprocating motion of the primary and secondary rams brings the various tooling members 13, 15, 17 and 19 adjacent one another to perform various tooling operations.

Figure 2:
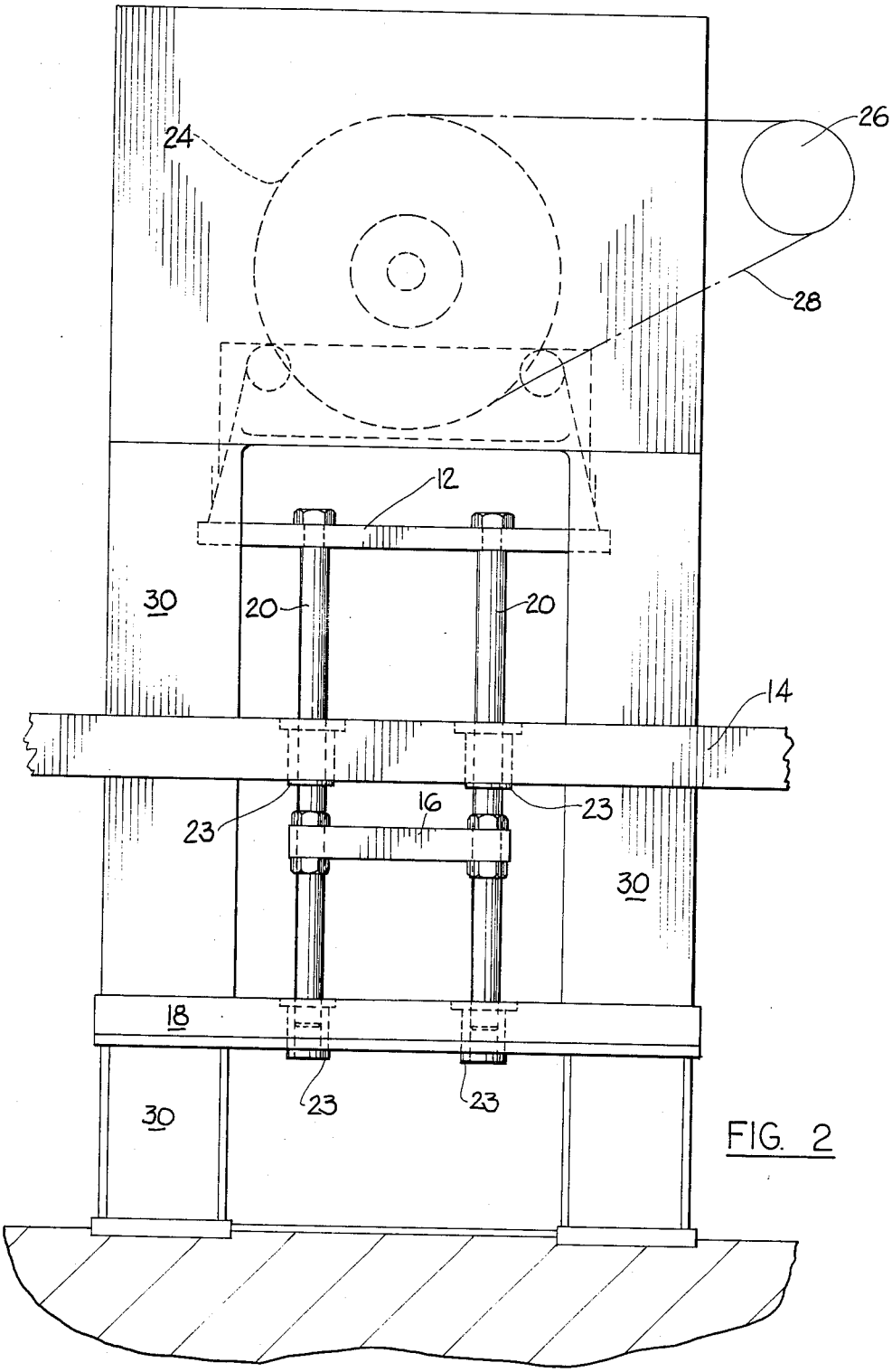
FIG. 2 is an elevational side view of a dual ram metalworking press having extended driving rods.

Optionally, as illustrated in FIG. 2, the driving rods 20 can extend from the primary ram 12 through the primary press bed 14 to the secondary ram 16 and to the secondary press bed 18. This assures that the downward movement by the secondary ram 16 will be vertically controlled and less inclined to shift laterally. As illustrated in FIG. 2, the secondary press bed 18 is provided with guides 23, and the driving rods 20 extend past the secondary ram 16 into and perhaps through the guides 23, thereby greatly reducing any potential lateral movement. Note that the secondary press bed 18 is vertically spaced above the foundation floor 32 to permit the driving rods 20 to extend through the guides 23 in the secondary press bed 18 and not impede the downward movement of the primary and secondary rams.

Figure 3:
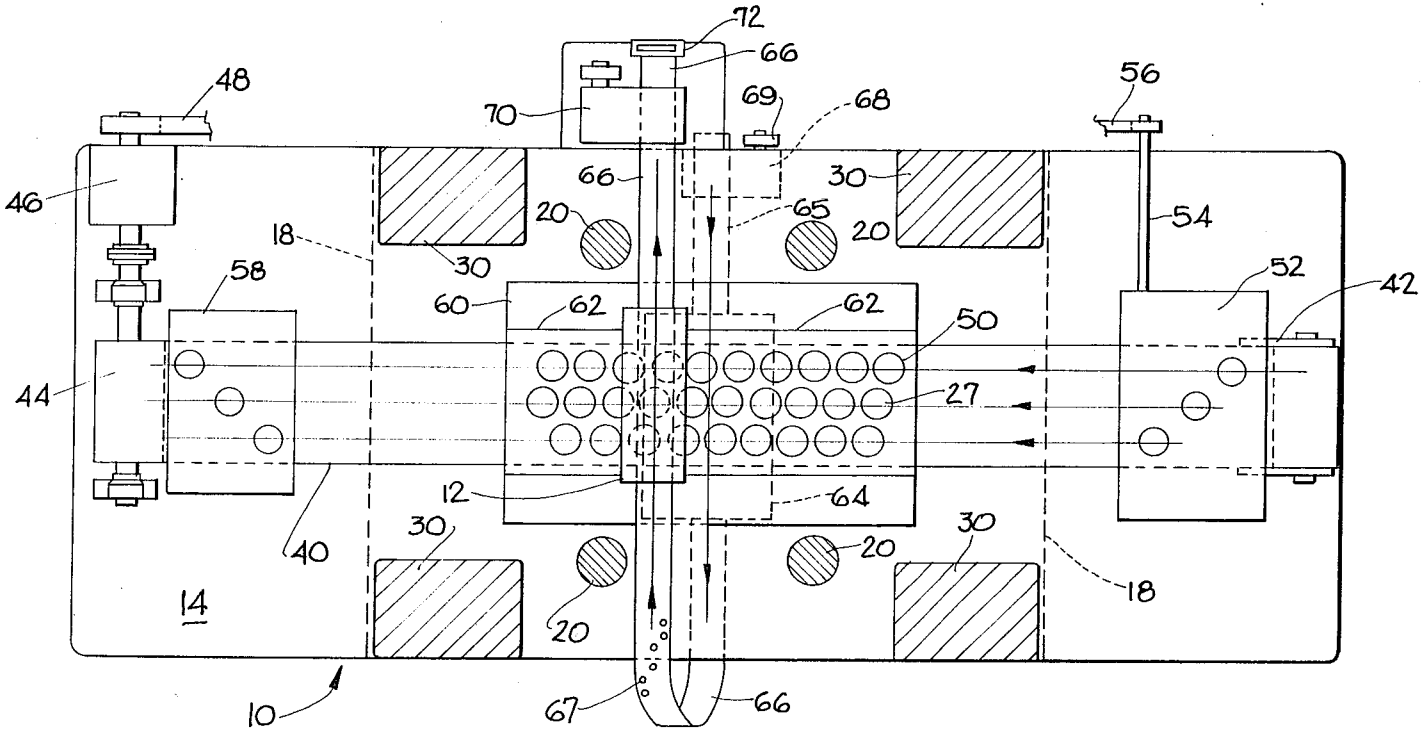
FIG. 3 is a plan view of a dual ram metalworking press taken in section immediately above the primary ram.

As best shown in FIGS. 3–5, the dual ram press may be an easy open can end conversion press. As illustrated in FIG. 3, an easy open conversion press 10 includes the primary press bed 14 having an endless belt 40 mounted over said primary press bed. The endless belt is driven about a free-wheeling drum roller 42 and a driven drum 44 which in turn is powered by an intermitter 46. The intermitter is driven by means of a belt 48 and a motor, not shown, as is conventionally known in the art.

The endless belt 40 includes three columns of workpieces such as can ends 27 offset with respect to one another so that they are linearally positioned at an angle with respect to a transverse plane across the belt 40. The angle the linear arrangement of the can ends forms with a perpendicular transverse plane is significant as will be described later. The endless belt 40 includes means to maintain the can ends 27 on the belt 40, such as conventional holes 50, or other known means.

When viewing FIG. 3, the belt 40 travels from the right-hand free wheeling drum roller 42 to the left-hand driven drum 44. Positioned immediately downstream of the free-wheeling drum roller 42 is an unstacking or downstacking system 52 which places blanked and formed can ends into the proper holes 50 in the endless belt 40. The unstacking or downstacking system 52 may be any type conventionally known. The downstacking system 52 is driven by a shaft 54 and a belt 56, which in turn is driven by a motor (not shown).

At the other end of the endless belt 40 adjacent the driven drum 44 is the upstacking system 58 of a type which is conventionally known. The upstacking system 58 removes the easy open can ends 27 from the endless belt 40.

Also positioned on the primary press bed 18 are four structural support columns 30 which serve to support the converter (not shown) over the primary press ram 12. As disclosed previously, the present application includes four driving rods 20, which extend through the primary press bed 14 and secure the primary press ram 12 to the secondary press ram 16 (not shown).

Centered between the driving rods 20 and positioned beneath the top flight of belt 40 and mounted upon primary press bed 14 is the lower tooling member 60. Positioned above and centered over belt 40 is the upper tooling member 62. The lower tooling member 60 and the upper tooling member 62 are conventional in the art for carrying out any one of the conventional steps employed to convert a can end into an easy open can end, namely, bubble forming, rivet forming, scoring and embossing, paneling, and tab staking.

Positioned below the primary press bed 14, as shown in phantom in FIG. 3, is the upper tooling member 64 for forming a component from the sheetmetal, such as a pull tab for use on an easy open can end. The upper tooling member 64 is positioned centrally within the driving rods 20. Such positioning is necessary in order that the secondary press ram (not shown) to which the upper tooling member 64 is attached can be lowered by the downward movement of the primary and secondary press rams. Also illustrated in phantom in FIG. 3 is the secondary press bed 18 which is positioned below the primary press bed 14, the position of the primary ram, primary press bed 14, secondary ram 16 and secondary press bed 18 are more clearly illustrated in FIGS. 4 and 5. Additionally, the driving rods 20 and the guides 23 extending through the primary press bed 14 are also more clearly illustrated in FIGS. 4 and 5.

As best shown in FIGS. 3–5, a pull tab strip 66 exits from the secondary press ram 16 and secondary press bed 18 and enters the primary ram 12 and primary press bed 14. The sheetmetal stock material 65 for the pull tap strip 66 is fed into the secondary press ram 16 and secondary press bed 18 by means of a roll feeder 68 illustrated in FIGS. 3 and 5. The roll feeder 68 is powered by a belt 69 and a motor (not shown). The stock sheetmetal material 65 enters beneath the secondary ram 16 and undergoes various tooling operations to form a plurality of pull tabs 67. Conventional steps in forming a pull tab 67 are to blank the general outline of the pull tab from a strip of sheetmetal 65, stamp certain relief areas near the edge of the pull tab, partially roll the edges of the pull tab and finish rolling the edges of the pull tab into a tight curl to provide peripheral strength to the pull tab. These operational steps are carried out between the secondary press ram 16 and the secondary press bed 18.

Once the pull tab strip 66 enters the area between the primary ram and the primary press bed 14, the three columns of pull tabs 67 on the strip 66 are positioned in alignment with the three columns of easy open can ends 27. The pull tabs 67 on the strip 66 are then staked to the easy open can ends 27 in a conventionally known manner. Another roll feeder 70 pulls the strip 66 no longer containing any pull tabs 67 from between the primary ram 12 and the primary press bed 14 as shown in FIGS. 3 and 5. A scrap chopper 72 proceeds to chop and cut the barren pull tab strip 66 into relatively uniform pieces so that the scrap aluminum may be reused.

As illustrated in FIG. 4, the downstacking system 52 comprises three or more tubes 73. Additionally, the upstacking system 58 also includes three tubes 76. The number of tubes in both the downstacking system 52 and the upstacking system 58 depends upon the columns of easy open can ends 27 positioned on endless belt 40.

In operation, stock sheetmetal 65 is fed by the lower roll feeder 68 between the secondary ram 16 and the secondary press bed 18 so that a plurality of operations may be formed upon the stock sheetmetal 65 to form pull tabs 67 for easy open can ends 27. The number of columns of pull tabs 67 depend upon the tooling for forming the pull tabs and upon the number of columns of can ends on belt 40. Although FIGS. 3 and 4 illustrate three columns of pull tabs 67 being formed from the stock sheetmetal 65, virtually any number of pull tabs could be formed, although the more columns of pull tabs formed, the more press tonnage required.

The pull tabs formed from the stock sheetmetal 65 are transformed into a pull tab strip 66 which exits between the secondary ram 16 and the secondary press bed 18 and enters into the tooling position between the primary ram 12 and the primary press bed 14. While the stock sheetmetal 65 is fed to the secondary unit by the lower roll feeder 68, the unstacking or downstacking system 52 is simultaneously feeding three columns of blanked and stamped can ends 27 into the holes 50 in the endless belt 40. The endless belt 40 is driven by the driven drum 44 to transport the can ends 27 between the primary ram 12 and the primary press bed 14 so that a plurality of tooling operations can be performed on the can ends converting them to easy open can ends. At some point during the operation of transforming the can ends into easy open can ends, it will be necessary to stake a pull tab 67 to a can end 27. At this point in the operation, the pull tab strip 66 is positioned over the easy open can ends 27 and three pull tabs 67 are simultaneously staked to three of the easy open can ends 27 in a diagonal alignment across endless belt 40, as illustrated in FIG. 3. The barren pull tab strip 66 is then removed from the space between the primary ram 12 and the primary press bed 14, while continued tooling operations are performed on the easy open can ends. Eventually, the easy open can ends 27 having the pull tabs 67 staked thereto are transported by the endless belt 40 to the upstaking system 58 where they are removed from the belt 40. The belt is then driven toward the free wheeling drum roller 42 so that it can be restocked with blank and formed can ends at the unstacking or downstacking system 52.

Although the columns of can ends 27 are shown as being offset to one another, i.e., the columns of can ends are not arranged linearly with respect to a transverse plane across belt 40, the can ends could be positioned at any desired angle, including being arranged linearly with respect to a transverse plane.

The preferred arrangement of the columns of can ends 27 is offset as illustrated in FIG. 3. This arrangement more efficiently utilizes the surface space of the endless belt 40, enabling the use of a thinner belt 40, and to permit more compact designs for the conversion press.

Likewise, the preferred arrangement of the pull tabs on the pull tab strip is the offset arrangement. Such an arrangement better utilizes the stock sheet material, thereby reducing waste. Nevertheless, the pull tabs could be formed on the pull tab strip at any angle, including being formed linearly with respect to a transverse plane.

Thus, it is apparent that there has been provided, in accordance with the invention, a dual ram press that fully satisfies the aims, aspects and advantages set forth above. While the invention has been described in conjunction with specific embodiments thereof, it is evident that many alternatives, modifications, and variations will be apparent to those silled in the art in light of the foregoing description. Accordingly it is intended to embrace all such alternatives, modifications, and variations as fall within the spirit and broad scope of the present invention.

What is claimed is:

1. A metalworking press comprising:

(a) a primary ram for suspending an upper tooling member, said primary ram secured to upper ends of a plurality of driving rods designed to reciprocate vertically;

(b) a primary press bed stationarily positioned beneath said primary ram for mounting a lower tooling member, said primary press including a plurality of holes for permitting said driving rods to reciprocate therethrough;

(c) a secondary ram positioned beneath said primary press bed for suspending another upper tooling member, said secondary ram secured to lower portions of said plurality of driving rods;

(d) a secondary press bed stationarily positioned beneath said secondary ram for mounting another lower tooling member, said secondary press bed having a plurality of holes, whereby said driving rods extend past said secondary ram and into said holes in said secondary press bed to insure proper alignment between said secondary ram and said secondary press bed and to prevent lateral movement of said secondary ram;

(e) means to vertically reciprocate said primary ram with said secondary ram whereby when said means moves said primary ram downwardly, said secondary ram moves downwardly and when said means moves said primary ram upwardly, said secondary ram moves upwardly, said means comprising said driving rods secured to said primary ram and said secondary ram so that said rams move in unison;

(f) an endless belt mounted about a driven drum and a freewheeling drum, said drums mounted on said primary press bed, said endless belt including a means to secure at least one workpiece thereon, said endless belt traversing a path which extends between said primary ram and said primary press bed; and (g) means mounted on said secondary press bed for feeding a strip of sheet material between said secondary ram and said secondary press to form a plurality of components from said strip of sheet material.

2. The metalworking press of claim 1, wherein said holes in said primary press bed include guide means to permit said driving rod to easily reciprocate through said holes.

3. The metalworking press of claim 2, wherein said guide means is selected from the group consisting of bronze bushings, ball bearings and roller bearings.

4. The metalworking press of claim 1, further including means mounted on said primary press bed for pulling said strip of sheet material between said upper and lower tooling members, above said endless belt so that said plurality of components from said strip can be employed on said workpiece.

* * * * *